US009401125B2

(12) United States Patent
Cho et al.

(10) Patent No.: US 9,401,125 B2
(45) Date of Patent: Jul. 26, 2016

(54) DISPLAY APPARATUS AND DISPLAY APPARATUS CONTROL METHOD

(71) Applicant: LG Display Co., Ltd., Seoul (KR)

(72) Inventors: Byoungchul Cho, Seoul (KR); Namyong Gong, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 210 days.

(21) Appl. No.: 14/270,732

(22) Filed: May 6, 2014

(65) Prior Publication Data

US 2014/0333673 A1 Nov. 13, 2014

(30) Foreign Application Priority Data

May 10, 2013 (KR) ..... 10-2013-0053362

(51) Int. Cl.

| | |
|---|---|
| ***G09G 5/00*** | (2006.01) |
| ***G09G 5/10*** | (2006.01) |
| ***G09G 5/02*** | (2006.01) |
| ***G09G 3/34*** | (2006.01) |
| *G09G 3/36* | (2006.01) |

(52) U.S. Cl.

CPC ..... *G09G 5/02* (2013.01); *G09G 3/3406* (2013.01); *G09G 3/3614* (2013.01); *G09G 2320/0247* (2013.01); *G09G 2320/064* (2013.01); *G09G 2320/0646* (2013.01); *G09G 2330/021* (2013.01); *G09G 2340/0435* (2013.01); *G09G 2380/14* (2013.01)

(58) Field of Classification Search

CPC ..... G09G 5/02; G09G 3/3406; G09G 3/3614; G09G 2320/0247; G09G 2320/064; G09G 2320/0646; G09G 2330/021; G09G 2340/0435; G09G 2380/14

See application file for complete search history.

(56) References Cited

U.S. PATENT DOCUMENTS

| | | | | |
|---|---|---|---|---|
| 2007/0247406 | A1 | 10/2007 | Zhou et al. | |
| 2008/0068359 | A1* | 3/2008 | Yoshida | G09G 3/3406 345/204 |
| 2010/0007599 | A1* | 1/2010 | Kerofsky | G09G 3/3413 345/102 |
| 2010/0156955 | A1* | 6/2010 | Kimura | G09G 3/3426 345/690 |
| 2011/0199364 | A1 | 8/2011 | Yamazaki et al. | |
| 2012/0212520 | A1 | 8/2012 | Matsui et al. | |

(Continued)

FOREIGN PATENT DOCUMENTS

| | | | |
|---|---|---|---|
| CN | 1842837 | A | 10/2006 |
| CN | 101170642 | A | 4/2008 |

(Continued)

OTHER PUBLICATIONS

Choi, I., et al., "Low-Power Color TFT LCD Display for Hand-Held Embedded Systems," ISLPED'02, Aug. 12-14, 2002, ACM, p. 112-117.

(Continued)

*Primary Examiner* — Charles Hicks

(74) *Attorney, Agent, or Firm* — Fenwick & West LLP

(57) ABSTRACT

A display apparatus includes a liquid crystal display (LCD) panel and a backlight coupled to the LCD panel. The LCD apparatus is capable of being operated in a plurality of modes. The gradation values of the image data is adjusted in accordance with gradation ranges, each gradation range having an upper limit gradation value and a lower limit gradation value. The first converted image data is then scaled by applying a scaling factor, followed by adjustment of backlight brightness. The frame rate of the LCD apparatus is also adjusted to implement the operation mode.

20 Claims, 6 Drawing Sheets

(56) References Cited

U.S. PATENT DOCUMENTS

| | | | |
|---|---|---|---|
| 2012/0229490 | A1 | 9/2012 | Rezaee |
| 2012/0320009 | A1 | 12/2012 | Liu |
| 2014/0015870 | A1 | 1/2014 | Takahashi et al. |

FOREIGN PATENT DOCUMENTS

| | | | |
|---|---|---|---|
| CN | 102741915 | A | 10/2012 |
| WO | WO 2012/137791 | A1 | 10/2012 |

OTHER PUBLICATIONS

Orouji, A., et al., "Leakage Current Reduction Techniques in Poly-Si TFTs for Active Matrix Liquid Crystal Displays: A Comprehensive Study," IEEE Transactions on Device and Materials Reliability, Jun. 2006, p. 315-325, vol. 6, No. 2, pp. 1-57.

European Search Report for European Patent Application No. EP 14167342, Sep. 10, 2014, 14 Pages.

Office Action for Chinese Patent Application No. CN 201410249569.1, Jan. 21, 2016, 23 Pages.

* cited by examiner

DISPLAY APPARATUS AND DISPLAY APPARATUS CONTROL METHOD

CROSS-REFERENCE TO RELATED APPLICATION

This application claims priority to and the benefit of Korean Patent Application No. 10-2013-0053362, filed on May 10, 2013, the disclosure of which is incorporated herein by reference in its entirety.

BACKGROUND

1. Field of the Invention

The present invention relates to a display apparatus and a display apparatus control method, and more particularly, to a display apparatus and a control method for imitating image characteristics of a physical paper with variable frame rate.

2. Discussion of Related Art

With the recent increase of interest in information display and demands for portable electronic devices, research and commercialization of lightweight and thin-shaped flat display apparatuses have been widely conducted. In particular, a liquid crystal display (LCD) apparatus among the flat display apparatuses has unique image characteristics such as brightness value, color temperature and contrast ratio. With much improved image characteristics, displays are becoming the primary tool for presenting a variety of media contents. In particular, eBooks or other text based contents that were originally presented on a printed paper are now increasingly being presented on displays. However, vast majority of users are still more familiar with reading books or text based contents on a physical paper than reading it on a display screen.

Attempts have been made to provide pleasurable viewing experience to the users in using the display apparatus for extended time. In this regards, a variety of screen modes, for example a cinema mode and a game mode, are provided in the displays. In applying the screen mode, various parameters of the image data may be adjusted so that the output image has the image characteristics suitable for the type of the contents presented on the display. Even with a variety of screen modes in display apparatus, however, it is difficult to provide the viewing experience similar to that of viewing or reading contents that are printed on a physical paper. Therefore, there remains a need for a screen mode or a display apparatus controlling method for mimicking the characteristics of a physical paper.

SUMMARY OF THE INVENTION

The image characteristics of a screen mode configured for imitating the characteristics of printed contents (referred hereinafter as the paper mode) are different from the image characteristics of the conventional screen modes. The inventors of the embodiments of the present disclosure recognized that, unlike the other screen modes, various properties of a physical paper must be taken into account in adjusting the parameters associated with the image data. Further, the static and continuous presentation of the printed contents also needs to be imitated on a frame rate driven display apparatus to fully appreciate the adjustments made to provide the viewing experience similar to that of viewing printed image contents.

Accordingly, there is provided a method controlling a display apparatus for imitating the image contents printed on a physical paper. When certain predetermined condition is met, the display apparatus operates in a mode that imitates the printed contents. The predetermined condition may include receiving a screen mode selection signal from a system. The predetermined condition may also include receiving the same image data for a plurality of frames. In other words, the result of the comparison can initiate or cease the operation of the display apparatus in the mode for imitating the image contents printed on a physical paper. When operating the display apparatus in such mode, a plurality of gradation ranges are identified. The plurality of gradation ranges may include a gradation range for red sub-pixels, a gradation range for green sub-pixels and a gradation range for blue sub-pixels. Each gradation range has an upper limit gradation value and a lower limit gradation value. Image data of a frame includes gradation values associated with each sub-pixels. These gradation values are adjusted in reference to the upper limit gradation value and the lower limit gradation value of the corresponding gradation range to generate the first converted image data. Then, the first converted image data is adjusted by a scaling factor. In addition, the brightness of the backlight is adjusted by an inverse proportion of the same scaling factor. The frame rate of the display apparatus is adjusted to enhance the effect of the operating mode.

In one embodiment, the gradation values included in the first converted image data are obtained by the following equations, $$R_{output} = R_{min} + \frac{R_{max} - R_{min}}{2^n - 1} \times R_{input} \quad \text{Eqn (1)}$$

$$G_{output} = G_{min} + \frac{G_{max} - G_{min}}{2^n - 1} \times G_{input} \quad \text{Eqn (2)}$$

$$B_{output} = B_{min} + \frac{B_{max} - B_{min}}{2^n - 1} \times B_{input} \quad \text{Eqn (3)}$$

wherein, $R_{input}$, $G_{input}$ and $B_{input}$ denote initial gradation values of the image data associated with one of the red sub-pixel, one of the green sub-pixel and one of the blue sub-pixel; $R_{output}$, $G_{output}$ and $B_{output}$ denote the gradation values in the first converted image data; $R_{max}$, $G_{max}$ and $B_{max}$ denote the upper limits of the respective gradation range, and $R_{min}$, $G_{min}$ and $B_{min}$ denote the lower limits of the respective gradation range.

In another aspect, there is provided a display apparatus, which is capable of imitating the image contents printed on a physical paper. The display apparatus includes a liquid crystal display (LCD) panel, a backlight coupled to the LCD panel and a controller that controls the operation of the LCD panel and the backlight. The controller is configured to identify a plurality of gradation ranges. The plurality of gradation ranges may include a gradation range for red sub-pixels, a gradation range for green sub-pixels and a gradation range for blue sub-pixels. Each gradation range has an upper limit gradation value and a lower limit gradation value. Image data of a frame includes gradation values associated with each of the sub-pixels. The controller is further configured to generate the first converted image data by adjusting the gradation values in the image data, which are associated with each of the sub pixels. The gradation values in the image data are adjusted in reference to the upper limit gradation value and the lower limit gradation value of the corresponding gradation range, such that the adjusted gradation values are included in the first converted image data. The controller is also configured to calculate the scaling factor and adjust the gradation values in the first converted image data by the scaling factor. The controller also adjusts the brightness of the backlight by an inverse proportion of the same scaling factor. Moreover, the controller is configured to adjust the frame rate of the display apparatus to enhance the effect of the operating mode.

In yet another aspect, there is provided a controller for imitating the printed image contents on a display apparatus. The controller is configured to identify a plurality of gradation ranges. The plurality of gradation ranges may include a gradation range for red sub-pixels, a gradation range for green sub-pixels and a gradation range for blue sub-pixels. Each gradation range has an upper limit gradation value and a lower limit gradation value. Image data of a frame includes gradation values associated with each of the sub-pixels. The controller is further configured to generate the first converted image data by adjusting the gradation values in the image data, which are associated with each of the sub pixels. The gradation values in the image data are adjusted in reference to the upper limit gradation value and the lower limit gradation value of the corresponding gradation range, such that the adjusted gradation values are included in the first converted image data. The controller is also configured to calculate the scaling factor and adjust the gradation values in the first converted image data by the scaling factor. The controller also adjusts the brightness of the backlight by an inverse proportion of the same scaling factor. Moreover, the controller is configured to adjust the frame rate of the display apparatus to enhance the effect of the operating mode.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Exemplary embodiments of the present disclosure will be described in detail below with reference to the accompanying drawings. While the present disclosure is shown and described in connection with exemplary embodiments thereof, it will be apparent to those skilled in the art that various modifications can be made without departing from the spirit and scope of the disclosure.

In this specification, like numbers refer to like elements throughout the description of the drawings. Although the terms first, second, etc. may be used to describe various elements, it should be understood that these elements are not limited by these terms. These terms are only used to distinguish one element from another. For example, a first element could be termed a second element, and, similarly, a second element could be termed a first element, without departing from the scope of exemplary embodiments.

In this specification, features of various embodiments of the present disclosure and the components therein may be partially or wholly combined with each other. Operations of the components and linkages between those components may be made possible in the technical manner as those skilled in the art can fully understand.

In this specification, a part of a module, a segment, or a formula including one or more practicable instructions for executing a certain logical function(s) may be shown in each of the blocks or the operations. These blocks or the operations may be performed independently from each other or performed in association with each other. Also, it should be appreciated that the functions described in each of the blocks or the operations may be exhibited out of sequence. For example, two blocks or operations shown in sequence may be executed substantially at the same time.

Figure 1:
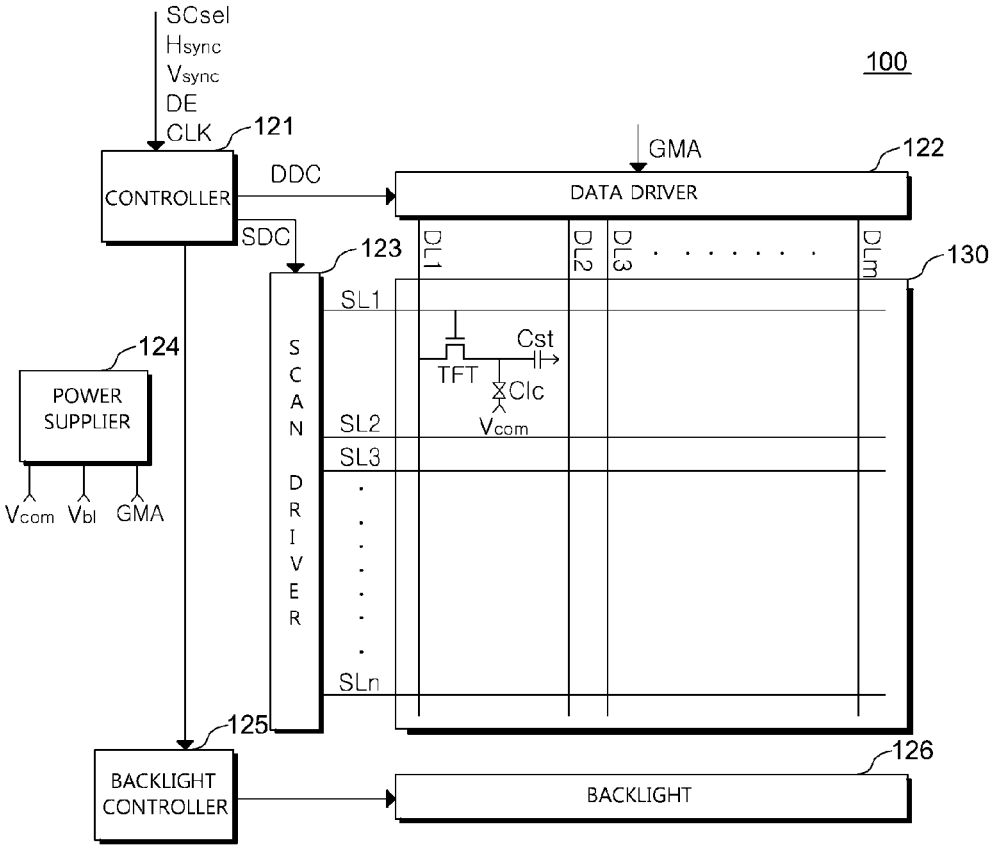
FIG. 1 is a conceptual diagram illustrating an LCD apparatus according to one embodiment of the present disclosure.

FIG. 1 is a schematic illustration of an exemplary LCD apparatus according to one embodiment of the present disclosure. The LCD apparatus 100 includes an LCD panel 130, a power supplier 124, a backlight 126, a backlight controller 125, a data driver 122, a scan driver 123 and a controller 121.

The LCD panel 130 includes a plurality of scan lines (SL1 through SLn), a plurality of data lines (DL1 through DLm), and a plurality of sub-pixels. For convenience of description, a single sub-pixel is illustrated in FIG. 1. The scan lines extend in one direction, and the data lines extend so as to cross the scan lines. In some cases, the scan lines and the data lines may extend parallel to each other. Each of the sub-pixels includes a liquid crystal cell (Clc), a capacitor (Cst) and one or more thin film transistors (TFTs), in which at least one of the TFTs is connected with a scan line and a data line. More specifically, one of the source electrode and the drain electrode of the TFT is electrically connected to the data line DL1, and the gate electrode is electrically connected to the scan line SL1.

The light required by the LCD panel 100 is emitted from the backlight 126, which may be implemented with fluorescent lamps or light emitting diodes. The brightness of the backlight 126 is controlled by the voltage transmitted from the backlight controller 125, which is determined based on the backlight control signal sent from the controller 121. The backlight control signal may be a pulse width modulation (PWM) duty signal, and the backlight controller 125 can generate a level shifted PWM duty signal, which can adjust the brightness of the backlight 126.

The power supplier 124 provides various voltages for operating the LCD display apparatus. For instance, the power supplier 124 may supply the common electrode voltage (Vcom) to the LCD panel 130. The power supplier 124 may also provide the backlight driving voltage (Vbl) to the backlight controller 125. Further, a gamma voltage (GMA) to the data driver 122 may be supplied from the power supplier 124. The Vcom is used for maintain the potential voltage of the common electrode of the LCD panel 130. The Vbl is used for supplying a power to the backlight 126. The GMA is used for converting the digital signal which is the second converted image data into the analogue signal. The polarity of the GMA is determined by polarity (POL) inversion signal. The level of gamma voltage determines the transmittance of the LCD panel 130. Although not shown in FIG. 1, the power supplier 124 may further include a DC/DC converter for supplying required voltages. The power supplier 124 may be formed as a separate IC.

Based on a variety of signals from the controller 121, the data driver 122 samples the image data, latches the sampled image data line by line for each horizontal period, and supplies the latched image data to data lines. As will be described in more detail below, the data driver 122 can be configured to convert the second converted image data into an analog voltage signal by using a GMA.

Based on a variety of signals from the controller 121, the scan driver 123 sequentially supplies a scan voltage to scan lines so that the output signals from the data driver 122 are provided to each sub-pixel of the TFTs. The scan driver 123 includes shift registers for sequentially generating a scan pulse and a level shifter for shifting a voltage of the scan pulse to a voltage level for switching the corresponding TFTs.

The controller 121, which is sometimes referred to as a processor, a timing controller or an image processing unit, may receive an image data by a variety of signal formats such as low-voltage differential signaling (LVDS), mobile industry processor interface (MIPI), RGB, and the like. Also, the controller 121 may be configured to receive a plurality of control signals such as a horizontal synchronization signal (Hsync), a vertical synchronization signal (Vsync), a data enable signal (DE), a clock signal (CLK) and a screen mode selection signal (SCsel) from a system (not shown). For convenience of description, hereinafter, it is assumed that the SCsel can activate the paper mode.

According to the aforementioned signals, the controller 121 generates various data driver control signal (DDC) to the data driver 122 and scan driver control signal (SDC) to the source driver 123. The DDC and SDC are generic terms which refer to a plurality of the control signals for controlling the data driver 122 and the scan driver 123, respectively. The DDC may include the image data signal, the source output enable (SOE) and POL inversion signal. The SOE is used in controlling the output timing of a latched image data signal from the data driver 122. The SOE can be modulated for controlling a frame rate of the LCD panel 130 when a paper mode is activated. The POL inversion signal is used to control the polarity of the GMA. The SDC may include a gate start pulse (GSP) signal and other signals provided to the scan driver 123. The controller 121 may also provide the backlight control signal to the backlight 126 to adjust its brightness.

Figure 2:
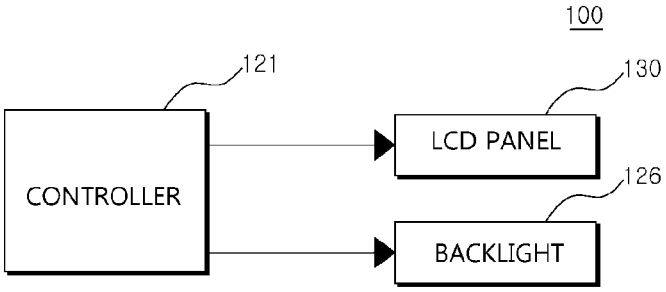
FIG. 2 is a conceptual diagram illustrating a controller according to one embodiment of the present disclosure.

FIG. 2 is a schematic diagram illustrating the basic operation of the controller 121 according to an embodiment of the present disclosure. When operating the LCD display apparatus 100 under the paper mode, the image contents on the LCD apparatus 100 are displayed by imitating the image content that are printed on a physical paper.

In particular, the image parameters of the image contents in paper mode may be determined by considering the properties of a physical paper such as a surface reflectance, a color temperature and a contrast ratio. The surface reflectance of the physical paper refers to the amount of light that is expected to reflect from the paper. The color temperature of the physical paper represents the whiteness of the paper. A paper with high color temperature would have bluish white color whereas a paper with low color temperature would have reddish white color. The contrast ratio of the physical paper refers to a ratio of the brightest color (e.g., background of the physical paper) to the darkest color (e.g., contents simulated to be printed on that specific physical paper) that is expressed on the paper under the ambient light. That is, the contrast ratio of the physical paper is the ratio between the brightness of the light reflected from the blank area of a physical paper (i.e., background) and the brightness of the light reflected from the contents area (i.e., printed area) of that physical paper.

In this disclosure, the image parameters of the LCD apparatus 100 may include maximum brightness, color temperature, contrast ratio. Assuming that a full white image contents are displayed on the LCD apparatus 100, the LCD apparatus 100 may have a maximum brightness value of 400 nits, a color temperature of 8000 K and a contrast ratio of 1500:1. This may be the limit of the LCD apparatus 100 when it is operating under the normal mode.

When the controller 121 receives SCsel to activate the paper mode, the controller 121 resets the image parameters of the LCD apparatus 100 so that they reflect the corresponding properties of the physical paper. That is, the maximum brightness value, color temperature value and contrast ratio value of the LCD apparatus 100 will be adjusted in accordance with the surface reflectance, color temperature and contrast ratio of a physical paper. When the parameters are reset by the controller 121, the LCD apparatus 100 may be adjusted to, for instance, a color temperature of 6500 K, a maximum brightness value of 190 nits and a contrast ratio of 32:1 for the same full white image contents.

Using the adjust image parameter values as the reference, the upper and lower limit gradation values for R, G and B can be obtained. For instance, the upper and lower limit gradation values may be as follows.

[$R_{max}$=245, $G_{max}$=250 and $B_{max}$=230]

[$R_{min}$=45, $G_{min}$=51 and $B_{min}$=52]

Such values set the gradation range for R, G and B for the stream of image data for each pixel while operating the LCD apparatus 100 under the paper mode. In other words, for each pixel, the gradation value of the image data will be adjusted in reference to the gradation range obtained above. Such values may vary depending on the specification of the LCD apparatus 100 (e.g., color gamut).

The determined upper and lower limit gradation range values are applied to Equation 1, Equation 2 and Equation 3.

$$R_{output} = R_{min} + \frac{R_{max} - R_{min}}{2^n - 1} \times R_{input} \quad \text{Eqn (1)}$$

$$G_{output} = G_{min} + \frac{G_{max} - G_{min}}{2^n - 1} \times G_{input} \quad \text{Eqn (2)}$$

$$B_{output} = B_{min} + \frac{B_{max} - B_{min}}{2^n - 1} \times B_{input} \quad \text{Eqn (3)}$$

The gradation value for R of the image data associated with a sub-pixel represents the "$R_{input}$" in the Equation 1. The gradation value for G of the image data associated with a sub-pixel represents the "$G_{input}$" in the Equation 2. The gradation value for B of the image data associated with a sub-pixel represents the "$B_{input}$" in the Equation 3. The determined upper limit value of the gradation ranges $R_{max}$, $G_{max}$ and $B_{max}$ are applied to Equation 1, Equation 2 and Equation 3. The determined lower limit of the gradation ranges $R_{min}$, $G_{min}$ and $B_{min}$ are applied to Equation 1, Equation 2 and Equation 3. The output gradation values $R_{output}$, $G_{output}$ and $B_{output}$ of the Equation 1, Equation 2 and Equation 3 represent the adjusted gradation values to be used while operating the LCD apparatus 100 in the paper mode. The image data defined by the output gradation values $R_{output}$, $G_{output}$ and $B_{output}$ may be referred hereinafter as the first converted image data. It should be noted that the output gradation values $R_{output}$, $G_{output}$ and $B_{output}$ are calculated for every frame for each pixel that is provided with the image data.

In some embodiments, $R_{max}$, $G_{max}$, $B_{max}$, $R_{min}$, $G_{min}$ and $B_{min}$ values and the aforementioned equations may be stored in a component of the LCD apparatus 100, for example the controller 121, to make the conversion process faster.

To imitate the image contents printed on a physical paper, the controller 121 is further configured to adjust the brightness of the backlight 126 when operating the LCD apparatus 100 under the paper mode. The brightness of the backlight 126 can be adjusted as much as the image parameters of the LCD apparatus 100 remain the same. That is, the maximum brightness, the color temperature and the contrast ratio will remain the same even when the brightness of the backlight 126 is adjusted.

To achieve this, the gradation values of the first converted image data associated with each pixel must be adjusted by a scaling factor. The controller 121 identifies the highest gradation value among the gradation values of the first converted image data associated with every pixel in a given frame. The highest gradation value may be a gradation value for any one of red, green or blue sub-pixels. Also, multiple sub-pixels of the first converted image may have the same gradation value, which may be the highest gradation value in a given frame.

The scaling factor is determined by dividing the maximum gradation value by the highest gradation value that is identified by the controller 121. Here, the maximum gradation value refers to the topmost gradation value, which can be expressed in a given image data format. In other words, the maximum gradation value is set by the digital bits of the image data format. For example, when the image data is in 8-bit format, there are $2^8$ gradations values ranging from 0 to 255. Consequently, the maximum gradation value is 255 for 8-bit format image data.

The scaling factor may be represented by the following Equation 4.

$$\text{Scaling factor} = \frac{\text{maximum gradation value}}{\text{highest gradation value of the first converted image data}} \quad \text{Eqn 4}$$

As the first conversion process was performed each pixels for every frame, the scaling factor must also be calculated on a frame by frame basis for the first converted image data. Using the scaling factor, the controller 121 carries out the second conversion process in which the first converted image data associated with each sub-pixel is multiplied by the scaling factor. By doing this, the highest gradation value of the first converted image data in a given frame is scaled up to the maximum gradation value (e.g., 255). Likewise, the rest of the sub-pixels of the first converted image data are scaled up in proportion to the scaling factor. The first converted image data that is scaled up by using the scaling factor may be referred hereinafter as the second converted image data.

In addition to the scaling the first converted image data into the second converted image data, the brightness of the backlight 126 is also adjusted by the scaling factor. That is, the backlight brightness may be adjusted by inverse proportion of the scaling factor. As described above, the PWM duty (i.e., high/low signal ratio) sets the brightness of the backlight 126. Accordingly, the controller 121 can adjust the PWM duty by inverse proportion of the scaling factor. As the ratio of the high signal within a PWM duty increases, the brightness of the backlight 126 increases. Conversely, the brightness of the backlight 126 will decrease as the ratio of the high signal duration within a PWM duty decreases.

Since the transmittance of the LCD panel 130 is defined by the gradation values of the image data, the transmittance of the LCD panel 130 can be increased with the use of the second converted image data, which is adjusted by the scaling factor. At the same time, the brightness of the backlight 126 is dimmed in accordance with the same scaling factor, thereby maintaining the image parameters of the LCD apparatus 100 operating under the paper mode.

By way of an example, assuming the scaling factor of 2 is used in the second conversion process, the transmittance of the LCD panel 130 will be increased by 50% and the duty of the backlight will be reduced by 50% thereof. Even though the brightness of the backlight 126 is reduced in half, the same brightness, color temperature and the contrast ratio can be provided due to the doubled light transmittance level of the LCD panel 130. In addition to mimicking the properties of a physical paper, operating the LCD apparatus 100 in this way can also reduce the power consumption.

Figure 3:
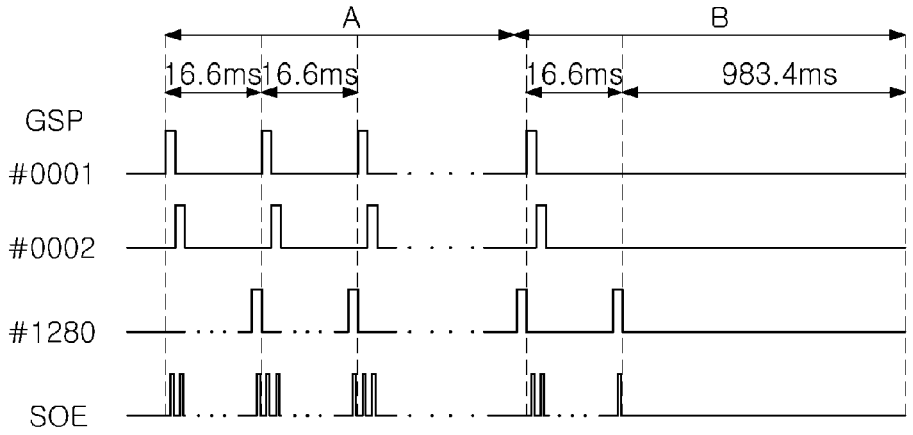
FIG. 3 is a timing diagram illustrating driving of an LCD apparatus according to one embodiment of the present disclosure.

FIG. 3 is a timing diagram illustrating an exemplary operation of an LCD apparatus 100 according to one embodiment of the present disclosure. As described briefly above, a physical paper provides the continuous viewing experience. In other words, a physical paper displays a static printed image. However, the LCD panel 130 refreshes the image for each frame in accordance with a frame rate, and the user may recognize the image refreshing. Consequently, the user may perceive the viewing experience different from a physical paper.

Accordingly, operating the LCD apparatus 100 with a lower frame rate may provide the viewing experience that is more similar to that of viewing the image contents printed on a physical paper. The controller 121 is configured to adjust the frame rate of the LCD panel 130 such that the LCD panel 130 operates at the lowered frame rate.

Referring to FIG. 3, the timing diagram of FIG. 3 illustrates a GSP and SOE which are applied to scan lines from #0001 to #1280 during sections A, and B. The section A represents the timing diagram before the adjustment of the frame rate, and the section B represents the timing diagram after the adjustment of the frame rate to provide a paper-like feeling on the LCD apparatus 100. In this example, a frame rate of 60 Hz at which the LCD panel 130 operates is adjusted to 1 Hz. However this is merely illustrative. As such, the LCD apparatus 100 may operate with a frame rate of 120 Hz, 240 Hz and the like. Also, the reduced frame rate of the LCD apparatus 100 can range preferably from 59 Hz to 30 Hz, more preferably from 30 Hz to 10 Hz, and more preferably from 10 Hz to 1 Hz. The lowest frame rate usable for the LCD apparatus 100 may vary based on the POL inversion signal and the type of LCD material.

Assuming the LCD panel 130 includes 1280×960×3 sub-pixels, there may be 960×3 of data lines for R, G and B sub-pixels and 1280×3 of scan lines. However, the number of sub-pixels of the LCD panel 130, the number of data lines of the LCD panel 130 and the number of scan lines of the LCD panel 130 are not limited.

In the section A, GSP is applied to a scan driver 123 so that a plurality of TFTs connected to #0001 to #1280 scan lines are sequentially turned on within one frame period (i.e., 16.6 ms) at 60 Hz frame rate. The SOE may be synchronized with a high edge of the respective GSP so that the second converted image data is supplied to the pixel electrode. In the section A, the GSP is provided to the scan driver 123 in every 16.6 ms, that is 60 times per second. The SOE is provided to the data driver 122 1280 times in every 16.6 ms in section A. Thus, the LCD panel 130 is operated at 60 Hz. The data voltage (analogue signals) representing the second converted image data is output from the data driver 122. The data voltage is applied to sub-pixels during a turn-on time of the TFT.

In the section B, GSP is applied to a scan driver 123 so that a plurality of TFTs connected to #0001 to #1280 scan lines are sequentially turned on within one frame period (i.e., 16.6 ms) and the SOE may be synchronized with a high edge of the respective GSP. Unlike the section A, however, the GSP and the SOE are not applied during the remaining period (i.e., 983.4 ms). Accordingly, the GSP and the SOE signals are provided from the controller 121 during only one frame (16.6 ms) within 1 second period, allowing the LCD panel 130 to operate at 1 Hz.

Although both the SOE and the GSP are controlled to adjust the frame rate in the example of FIG. 3, it should be appreciated that the frame rate adjustment of the embodiments in the present disclosure can be implemented by controlling just one of SOE and GSP. For example, the frame rate of the LCD apparatus 100 can be adjusted by reducing only the frequencies of the SOE without changing the timing of the GSP.

The frame rate to be used during the operation of the LCD apparatus 100 in the paper mode can be determined by the controller 121. The controller 121 may change the frame rate based on comparison of two or more image frames in a sequence. More specifically, the controller 121 may determine whether the second converted image data of two adjacent frames are the same. When the second converted image data of the two adjacent frames are the same for a predetermined period of time, the image contents to be displayed on the LCD apparatus 100 may be determined as a still image. In this case, the controller 121 may reduce the frame rate. This image data comparison can be performed periodically by the controller 121, and when the change between the second converted image data of the two frames are detected, the controller 121 may increase the frame rate back to the normal.

During the blank period, in addition to the GSP, at least one or all of a clock signal (Clk), a start signal, a reset signal may not be applied. The controller 121 may stop supplying all driving powers except for Vcom and VGL during the blank period. That is, the controller 121 may stop supplying all power except for power for maintaining the potential between the pixel electrode and the common electrode. By reducing the number of signals provided from the controller 121 during the blank period, the power consumption of the LCD apparatus 100 can be reduced. When interlaced scanning is used for the LCD apparatus 100, in which the odd numbered gate lines and even numbered gate lines are alternately scanned, the number of signals can be reduced further, thereby minimizing the power consumption.

When reducing the frame rate of the LCD apparatus 100, a backplane implemented with TFTs having improved voltage holding ratio can be particularly helpful as it allows maintaining the data voltage applied to a storage capacitor (Cst) and/or a pixel electrode for longer period of time. The TFT off-current characteristic of the material for the active layer determines the amount of leakage current. The higher the leakage current, more evident and frequent the flickers. In some embodiments, the TFT used in the LCD panel 130 has the TFT off-state current characteristic of $1\times10^{-13}$ A or less, and preferably, $1\times10^{-15}$ A or less. Non-limiting example of the TFT, which may provide such off-state current characteristic, includes a TFT having its active layer formed of an oxide semiconductor material. Generally, the oxide semiconductor provides higher voltage holding ratio than other types of semiconductor materials such as a-Silicon or Poly-Silicon.

As for the constituent material for the oxide semiconductor active layer may include, for example, indium tin gallium zinc oxide (InSnGaZnO)-based materials which are quaternary metal oxides, indium gallium zinc oxide (InGaZnO)-based materials which are ternary metal oxides, indium tin zinc oxide (InSnZnO)-based materials, indium aluminum zinc oxide (InAlZnO)-based materials, aluminum gallium zinc oxide (AlGaZnO)-based materials, tin aluminum zinc oxide (SnAlZnO)-based materials, indium zinc oxide (InZnO)-based materials which are binary metal oxides, tin zinc oxide (SnZnO)-based materials, aluminum zinc oxide (AlZnO)-based materials, zinc magnesium oxide (ZnMgO)-based materials, tin magnesium oxide (SnMgO)-based materials, indium oxide (InO)-based materials, indium gallium oxide (InGaO)-based materials, indium oxide (InO)-based materials, tin oxide (SnO)-based materials, zinc oxide (ZnO)-based materials, and the like. A composition ratio of each element included in each of the above-described oxide semiconductor materials is not particularly limited, and can be adjusted in various ways. Also, a band gap of the oxide semiconductor layer may be 2 eV or more, and a carrier concentration of the oxide semiconductor may be reduced close to zero.

Figure 4:
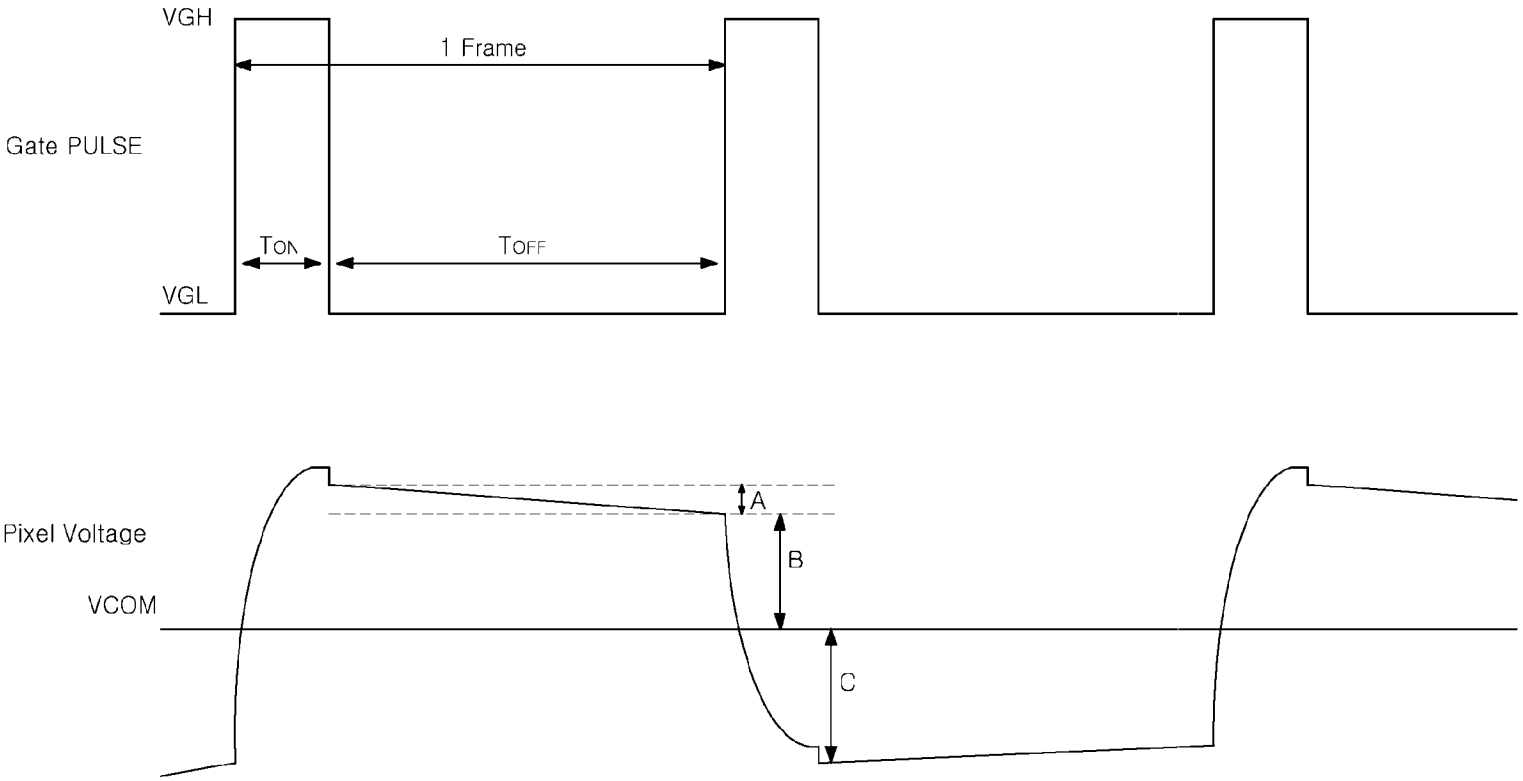
FIG. 4 is a timing diagram illustrating a voltage drop of a thin-film transistor (TFT) during a TFT off interval.

Reducing the leakage current leads to less voltage drop during the turn-off interval, i.e., Toff in FIG. 4. Minimizing the voltage drop during the off interval provides longer period of time in which the voltage charged on the pixel electrode and/or the voltage charged in the storage capacitor is maintained at the usable level. This makes it easier to operate the LCD apparatus 100 with lower frame rate. Even when the LCD apparatus 100 is operated at the frame rate of 1 Hz or less, a voltage drop is minimized during the off interval due to a low TFT off-state current, and therefore a stable image contents can be provided.

The change in the frame rate facilitates the LCD apparatus 100 to imitate the physical paper. However, there are a few issues associated with operating the LCD apparatus 100 in a lower frame rate. When the frame rate is reduced, a data voltage applied to a storage capacitor (Cst) or a pixel electrode may also decrease due to the leakage current in accordance with the off-current characteristic of the TFT in each sub-pixels. With the lowered frame rate, the time for the TFT to maintain the data voltage becomes longer. As the amount of cumulative leakage current in the sub-pixel increases, it becomes harder to maintain the uniform brightness.

FIG. 4 is a timing diagram illustrating a voltage drop of one exemplary TFT during a TFT off interval. FIG. 4 indicates a state in which a voltage drop occurs in a pixel electrode voltage over time during the TFT off interval due to an off-state leakage current of the TFT.

Based on the gate pulse shown in FIG. 4, a single frame may be divided into a turn-on (Ton) interval and a turn-off (Toff) interval. Here, the gate pulse is maintained high (VGH) in the turn-on interval, and maintained low (VGL) in the turn-off interval. The voltage difference between the beginning and the end of the turn-off interval is indicated as A, and the voltage at the end of the turn-off interval is indicated as B based on VCOM. In addition, it is assumed that inversion of a data voltage occurs every one frame.

The pixel electrode voltage is charged by a positive data signal (not shown) in the turn-on interval, and is gradually reduced after the slight voltage drop in the turn-off interval.

The pixel electrode voltage is charged with a negative data signal at the beginning of the turn-on (Ton) interval of the following frame. When an inverted POL inversion signal is applied (not shown) at the beginning of the following frame, the polarity of the voltage is also inverted. The voltage at the beginning of the turn-off interval of the following frame is indicated as C and the difference between the voltage B and the voltage C corresponds to a brightness difference (or transmittance of the LCD panel) between the frames. This brightness difference causes unwanted flickers, which may be recognized more easily when operating the LCD apparatus 100 in the paper mode.

Figure 5:
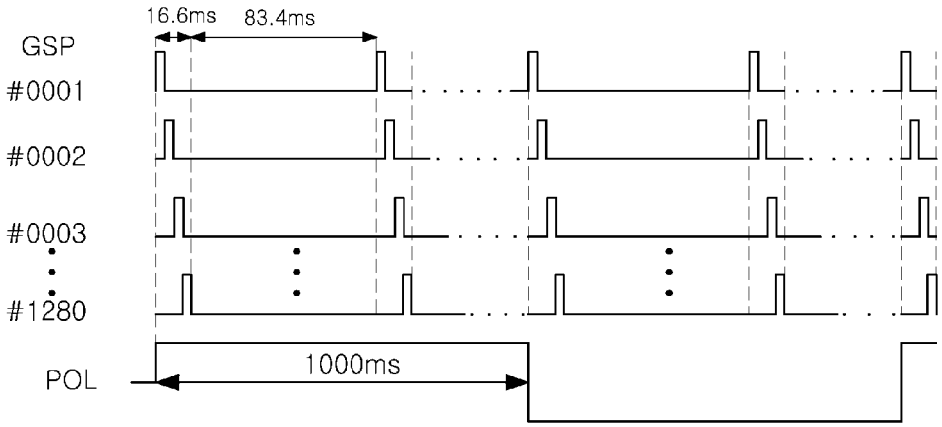
FIG. 5 is a timing diagram illustrating driving of an LCD apparatus according to another embodiment of the present disclosure.

To this end, the flicker phenomenon described above can be alleviated by modulating the POL inversion signal. Accordingly, in an embodiment, the controller 121 may be configured to modulate the POL inversion signal as illustrated in FIG. 5. By reducing the inversion frequency of the POL inversion signal, the pixel electrode voltage of the same polarity can be provided for a plurality of frames, and this can minimize the recognition of the flicker.

The POL inversion signal is a signal for controlling polarity of a pixel electrode voltage and for suppressing a residual image of the LCD panel. In other words, the POL inversion signal is to prevent a burn-in phenomenon of the LCD apparatus. Generally, the polarity of the pixel electrode voltage is conventionally reversed in every frame in accordance to the polarity of the POL inversion signal. However, in this embodiment, the polarity of the POL inversion signal is inverted in every two or more frames rather than being inverted per each frame.

Accordingly, the second converted image data is charged to the pixel electrode of the LCD apparatus 100 during only 10 frames (each frame being 16.6 ms) within 1 second period, allowing the LCD panel 130 to operate at 10 Hz. It should be noted that the frame rate used herein is merely illustrative, and the LCD apparatus 100 may be operated at various other frame rates. There is a blank period of 83.4 ms in between each of the frames. Assuming the LCD apparatus 100 includes 1280×960 pixels, the GSP is sequentially applied to 1280 lines during a first period of 16.6 ms, and is not input during a second period of 83.4 ms. A pixel electrode voltage may be applied to a liquid crystal and is not re-charged with a new pixel electrode voltage during the blank period.

In the example shown in FIG. 5, the polarity of the POL inversion signal is maintained for 1000 ms. As such, the pixel electrode voltages of positive polarity are applied for the first 10 frames, and the pixel electrode voltages of negative polarity are applied for the next 10 frames. Although the inversion period of 1000 ms for the POL inversion signal is used, the inversion period can be adjusted to provide stable operation of the LCD apparatus 100 with a reduced frame rate. For instance, the POL inversion period should be determined in consideration of the trade-off relations of the flicker and the burn-in phenomenon of the LCD apparatus 100. Accordingly, the POL inversion period may range from 1000 ms to 500 ms, and more preferably from 500 ms to 300 ms, and more preferably 300 ms to 200 ms, and more preferably from 100 ms to 32 ms.

Another issue in adjusting the frame rate is that a temporary flicker may occur in early frames. For example, a user can easily recognize the sudden changes when the paper mode is applied. This is because the frame rate and the image parameters of LCD apparatus 100 are changed at once. Although the temporary flicker may be limited to the first few frames of the transition from the normal mode to the paper mode, the rate of change may be undesirably fast for some users.

Reducing the rate in which the frame rate adjustment is carried out by the controller 121 can alleviate this issue. Accordingly, in some embodiments, the controller 121 may perform the frame rate adjustment in a step-wise manner as illustrated in FIG. 6.

In reaching the desired frame rate to be used in the paper mode operation of the LCD apparatus 100, its frame rate can be adjusted in a fraction. For example, only one tenth of the total adjustment amount can be carried out for ten times at a certain interval. The frame rate may be changed over a long enough period of time such that the user does not recognize the temporary flicker during the transition of the operating modes. However, excessively long period in adjusting the frame rate may defeat the purpose of using the paper mode. Ideally, modulating the frame rate by a fraction of ten is desired for sufficient suppression of the temporary flicker recognition, but it can be modulated in any other fractions if necessary.

Figure 6:
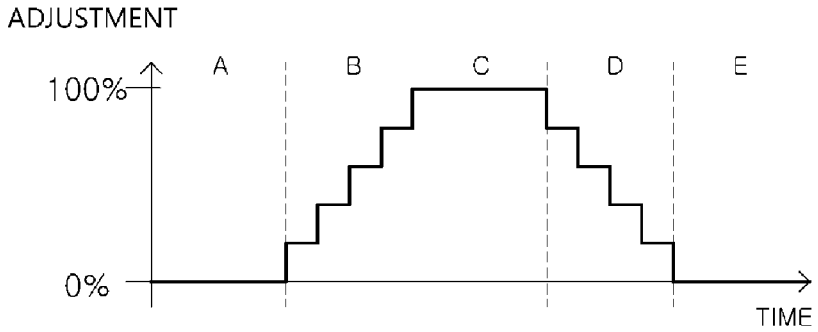
FIG. 6 is a table illustrating a recognition level with respect to flicker and power consumption of an LCD apparatus at various POL inversion frequencies.

In FIG. 6, the x-coordinate indicates time and the y-coordinate indicates an adjustment rate (%) of the target frame rate. The target frame rate is the frame rate to be used in the paper mode operation of the LCD apparatus 100, which is determined by the controller 121. For example, the frame rate of the LCD apparatus 100 in the normal mode may be 60 Hz and its target frame rate determined by the controller 121 may be 1 Hz.

The adjustment rate of the target frame rate is shown in sections A, B, C, D, and E. The section A of FIG. 6, the adjustment rate is 0%, and thus the LCD apparatus 100 is operated at the frame rate of 100 Hz. In the section B, the adjustment rate is increased in an incremental manner until the target frame rate is reached. At the first interval of the section B, the controller 121 adjusts the frame rate by the adjustment rate of 20%. This causes the frame rate of the LCD apparatus 100 to 80 Hz. After a number of frames (i.e., the second interval of the section B), the controller 121 adjust the frame rate by the adjustment rate of 40%, and thus the frame rate is adjusted to 60 Hz. Likewise after another plurality of frames, the frame rate is adjusted by the adjustment rate of 60% followed by the adjustment rate of 80%, resulting in the frame rate of 40 Hz followed by 20 Hz. At the end of the section B, the frame rate is adjusted by the adjustment rate of 100%, making the frame rate to reach the target frame rate, 1 Hz. The number of intervals and the adjustment rate for each interval used in this example is merely illustrative. The controller 121 may be configured to adjust the frame rate of the LCD apparatus 100 in various other numbers of the intervals of varying degree of adjustment rates.

In the section C of FIG. 6, the LCD apparatus 100 is operated at the target frame rate of 1 Hz. When changing the operating mode of the LCD apparatus 100 back to the normal mode, the frame rate is adjusted back to its normal rate. In the section D, the adjustment rate decreases in a step-wise manner from 100% to 0%, in the reverse manner of the section B. For example, the frame rate of the LCD apparatus 100 is adjusted from 1 Hz (100%), 20 Hz (80%), 40 Hz (60%), 60 Hz (40%), 80 Hz (20%) and to 100 Hz (0%) in an incremental manner. While the example depicted in FIG. 6 illustrates the adjustment rate in the section D being symmetrical to the adjustment rate in section B, the adjustment rate used for the sections B and D may differ from each other. In the section E, the frame rate is maintained at 100 Hz.

Figure 7:
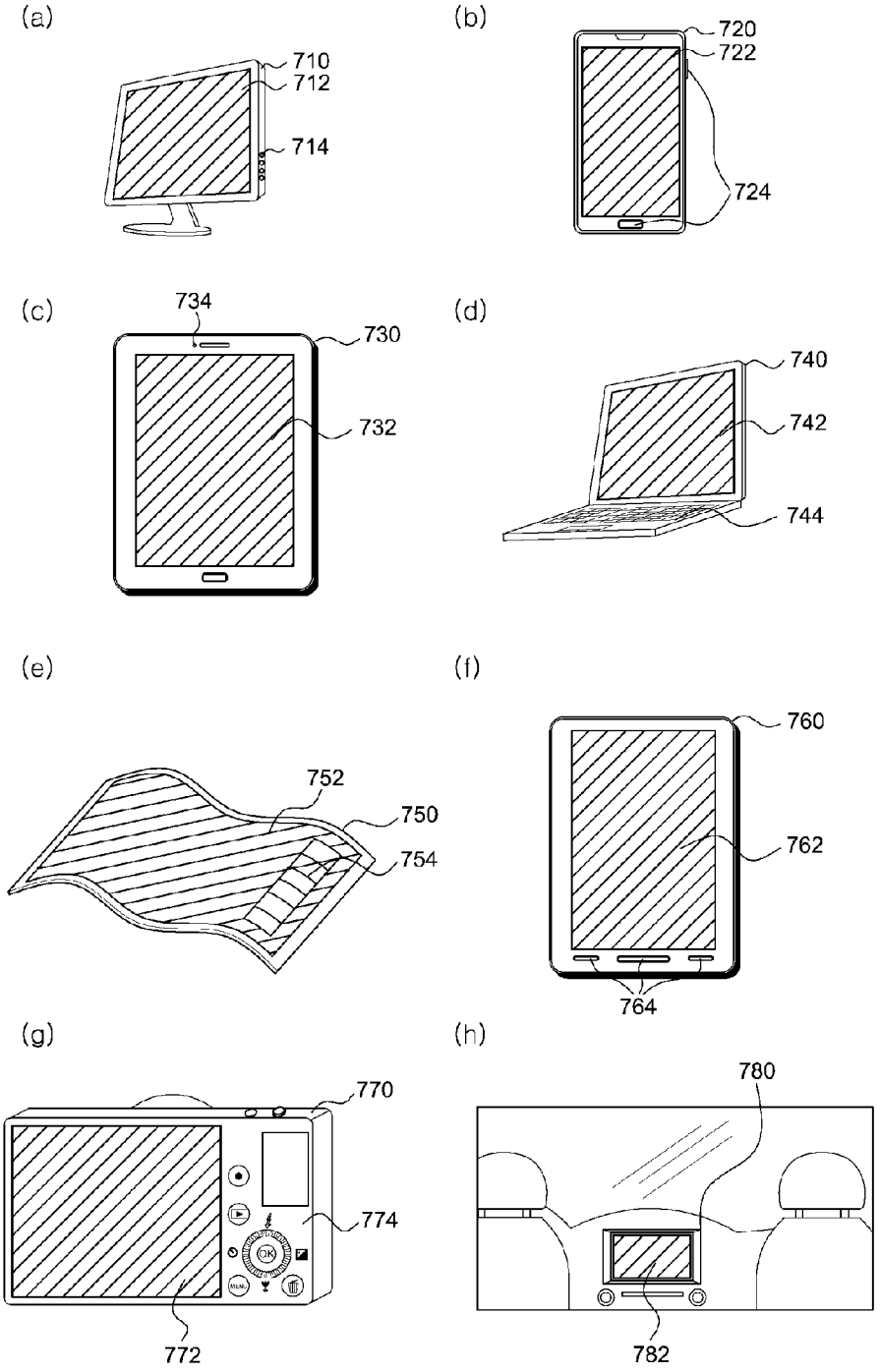
FIG. 7 is schematic diagrams illustrating a plurality of devices to which a display device according to one exemplary embodiment of the present disclosure can be applied.

FIG. 7 is schematic diagrams illustrating a plurality of devices to which a display device according to one exemplary embodiment of the present disclosure can be applied.

A portion (a) of FIG. 7 illustrates a case in which a display apparatus according to various embodiments of the present disclosure is used as a display device 710.

A portion (b) of FIG. 7 illustrates a case in which a display apparatus 722 according to various embodiments of the present disclosure is a mobile communication device 7920.

A portion (c) of FIG. 7 illustrates a case in which a display apparatus 732 according to various embodiments of the present disclosure is used as a tablet PC 730.

A portion (d) of FIG. 7 illustrates a case in which a display apparatus 742 according to various embodiments of the present disclosure is used as a notebook computer 740.

A portion (e) of FIG. 7 illustrates a case in which a display apparatus 752 according to various embodiments of the present disclosure is used as a flexible display device 7950.

A portion (f) of FIG. 7 illustrates a case in which a display apparatus 762 according to various embodiments of the present disclosure is used as an e-book device 760.

A portion (g) of FIG. 7 illustrates a case in which a display apparatus 772 according to various embodiments of the present disclosure is used as a digital camera 770.

A portion (h) of FIG. 7 illustrates a case in which a display apparatus 782 according to various embodiments of the present disclosure is used as a navigation device 780 for vehicles.

Figure 8:
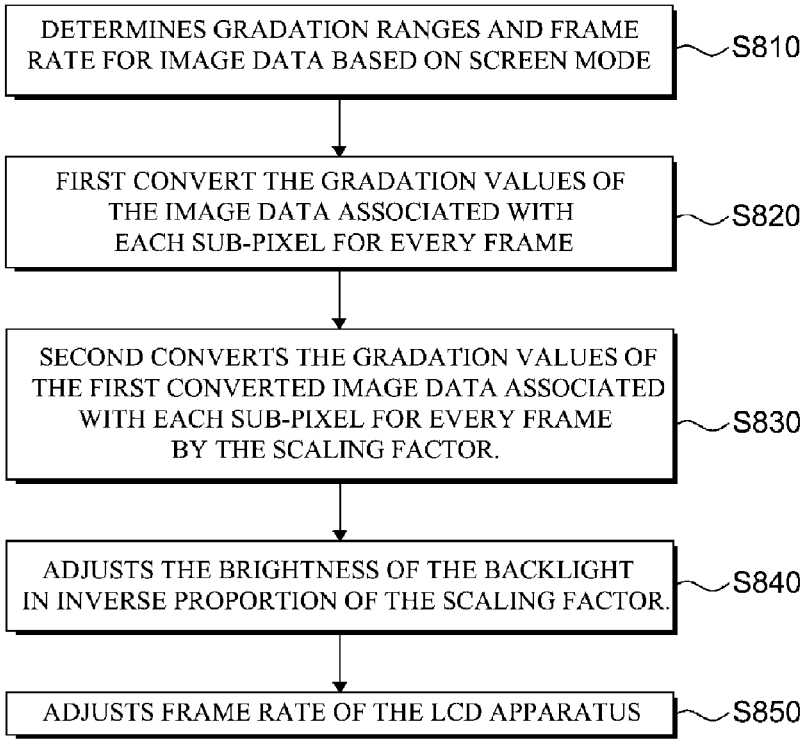
FIG. 8 is a flowchart illustrating a display method of an LCD apparatus according to one embodiment of the present disclosure.

FIG. 8 is a flowchart illustrating a display method of an LCD apparatus 100 according to one embodiment of the present disclosure. For convenience of description, the display method will be described below with reference to a controller of the LCD apparatus 100.

In S810, the controller 121 of the LCD apparatus 100 determines gradation ranges and a frame rate for an image data based on a screen mode to be used for the LCD apparatus 100. The screen mode can be a screen mode to imitate the image contents printed on a physical paper, i.e., the paper mode. The gradation range includes an upper limit gradation value and a lower limit gradation value. The gradation range is within the implementable gradation range of the LCD apparatus 100.

In S820, the controller 121 of the LCD apparatus 100 first convert the gradation values of the image data associated with each sub-pixel for every frame (during the paper mode) in reference to the gradation range between an upper limit gradation value and a lower limit gradation value. In adjusting the gradation values, the controller 121 uses the above described Equation 1, 2 and 3.

In S830, the controller 121 of the LCD apparatus 100 second converts the gradation values of the first converted image data associated with each sub-pixel for every frame by the scaling factor. The scaling factor is calculated by using the maximum gradation value and the highest gradation value among the first converted image data (i.e., gradation values) associated with the sub-pixels in a given frame. The scaling factor can be determined for every frame of the image data by using the equation 4. The scaling factor is then applied to all the pixels of the first converted image data so as to scale up the highest gradation values of the first converted image data to reach the maximum gradation upper limit.

In S840, the controller 121 of the LCD apparatus 100 adjusts the brightness of the backlight 126 in an inverse proportion of the scaling factor. By applying the inverse of the scaling factor, the brightness of the backlight 126 can be reduced. However, since the transmittance level of the LCD panel 130 is increased by the scaled gradation values, the image parameters of the LCD apparatus 100 are maintained.

In S850, the controller 121 of the LCD apparatus 100 adjusts a frame rate of the LCD apparatus 100.

The embodiments of the present disclosure provide improved viewing experience as if the image content is printed on a physical paper. In addition, the power consumption in the LCD apparatus 100 can be reduced. The power consumption of the LCD apparatus 100 depends on the backlight power consumption and the LCD panel power consumption. The backlight power consumption varies based on the brightness of the backlight 126. Reducing the brightness of the backlight 126 during the paper mode operation of the LCD apparatus 100 lowers the backlight power consumption.

Also, the LCD panel power consumption may be reduced by reducing the frame rate during the paper mode operation of the LCD apparatus 100. The LCD panel power consumption may be determined by the following equation.

$$P \propto C \times V^2 \times f$$

In the equation shown above, P denotes the power of the LCD panel, C denotes the parasitic capacitance of the LCD panel 130, V denotes the voltage level of the signal input to the LCD panel 130, and f denotes the frequency of the signal input to the LCD panel 130. Consequently, when the frequency is reduced, the power consumption of the LCD panel 130 can be reduced.

A combination of blocks in an accompanying block diagram and a combination of operations in a flowchart may be performed by algorithms or computer program instructions which are composed of a firmware, software, or hardware. The instructions used to execute the computers or the other programmable data processing equipment can provide operations for executing the functions described in each of the blocks in the block diagram or each of the operations in the flowchart.

Operations of the methods or algorithm described in connection with the exemplary embodiments disclosed in this specification may be directly implemented using a hardware module, a software module, or a combination thereof executed by a processor. The software module may be permanently installed on a RAM memory, flash memory, ROM memory, EPROM memory, EEPROM memory, register, hard disk, detachable disk, CD-ROM, or any other types of storage media known in the related art. An exemplary storage medium may be coupled to a processor, so that the processor can read information from a storage medium and write information in a storage medium. For an alternative example, a storage medium may be formed integrally with a processor. In this case, the processor and the storage medium may be permanently mounted in an application-specific integrated circuit (ASIC). The ASIC may be permanently mounted in a user terminal. For an alternative example, the processor and the storage medium may be permanently mounted as separate components in a user terminal.

It will be apparent to those skilled in the art that various modifications can be made to the above-described exemplary embodiments of the present disclosure without departing from the spirit or scope of the disclosure. Thus, it is intended that the present disclosure covers all such modifications provided they come within the scope of the appended claims and their equivalents.

What is claimed is:

1. A method of controlling a display apparatus, the method comprising:

determining a screen mode in which at least one among maximum brightness value, color temperature value and contrast ratio value is adjusted in accordance with surface reflectance, color temperature and contrast ratio of a physical paper;

determining gradation ranges for operating the display apparatus in the screen mode, each gradation range having an upper limit gradation value and a lower limit gradation value;

adjusting gradation values of an image data associated with each sub-pixel in a frame to generate a first converted image data for the frame, wherein the gradation values of the image data are adjusted to be within a range between the upper limit gradation value and the lower limit gradation value of the corresponding gradation range;

adjusting gradation values of the first converted image data associated with each sub-pixel in the frame by a scaling factor;

adjusting the brightness of a backlight by an inverse proportion of the scaling factor; and adjusting a frame rate of the display apparatus.

2. The method of claim 1, wherein the first converted image data includes the gradation values associated with a plurality of red sub-pixels, a plurality of green sub-pixels, and a plurality of blue sub-pixels that are adjusted by the following equation, $$R_{output} = R_{min} + \frac{R_{max} - R_{min}}{2^n - 1} \times R_{input} \quad \text{Eqn (1)}$$

$$G_{output} = G_{min} + \frac{G_{max} - G_{min}}{2^n - 1} \times G_{input} \quad \text{Eqn (2)}$$

$$B_{output} = B_{min} + \frac{B_{max} - B_{min}}{2^n - 1} \times B_{input} \quad \text{Eqn (3)}$$

wherein, $R_{input}$, $G_{input}$ and $B_{input}$ denote initial gradation values of the image data associated with one of the red sub-pixel, one of the green sub-pixel and one of the blue sub-pixel; $R_{output}$, $G_{output}$ and $B_{output}$ denote the gradation values in the first converted image data; $R_{max}$, $G_{max}$ and $B_{max}$ denote the upper limits of the respective gradation range; $R_{min}$, $G_{min}$ and $B_{min}$ denote the lower limits of the respective gradation range; and n denotes the number of bits of the image data.

3. The method of claim 1, wherein the scaling factor is calculated by the following equation, $$\text{Scaling factor} = \left(\frac{\text{maximum gradation value}}{\text{highest gradation value of the first converted image data}}\right) \quad \text{Eqn 4}$$

wherein the maximum gradation value is associated with one among red, green and blue sub-pixels.

4. The method of claim 1, wherein the generation of the first converted image data and the calculation of the scaling factor is performed for a plurality of frames.

5. The method of claim 1, wherein the frame rate is adjusted in accordance to a comparison result between the image data of a plurality of frames.

6. The method of claim 5, wherein the frame rate of the display apparatus is reduced by reducing a frequency of a source output enable (SOE) signal.

7. The method of claim 1, further comprising adjusting a polarity (POL) inversion period of the display apparatus.

8. The method of claim 7, wherein the POL inversion period is at least two times longer than a period of one frame.

9. The method of claim 8, wherein the POL inversion period is between 100 ms to 500 ms.

10. The method of claim 1, wherein the frame rate of the display apparatus is adjusted in a step-wise manner.

11. A display apparatus comprising:

a liquid crystal display (LCD) panel;

a backlight coupled to the LCD panel; and a controller configured to determine a screen mode in which at least one among maximum brightness value, color temperature value and contrast ratio value is adjusted in accordance with surface reflectance, color temperature and contrast ratio of a physical paper;

determine gradation ranges for operating the display apparatus in the screen mode, each gradation range having an upper limit gradation value and a lower limit gradation value;

adjust gradation values of an image data associated with each sub-pixel in a frame to generate a first converted image data for the frame, wherein the gradation values of the image data are adjusted to be within a range between the upper limit gradation value and the lower limit gradation value of the corresponding gradation range;

adjust gradation values of the first converted image data associated with each sub-pixel in the frame by a scaling factor;

adjust the brightness of a backlight by an inverse proportion of the scaling factor, and adjust a frame rate of the display apparatus.

12. The display apparatus of claim 11, wherein the generation of the first converted image data and the calculation of the scaling factor is performed for a plurality of frames.

13. The display apparatus of claim 11, wherein the frame rate of the display apparatus is reduced by reducing a frequency of a source output enable (SOE) signal.

14. The display apparatus of claim 11, wherein the LCD panel includes a thin-film transistor having a semiconductor layer of which off-state current is $1\times10^{-15}$ A or less.

15. The display apparatus of claim 11, further comprising adjusting a polarity (POL) inversion period of the display apparatus.

16. The display apparatus of claim 15, wherein the POL inversion period is at least two times longer than a period of one frame.

17. The display apparatus of claim 11, wherein the frame rate of the display apparatus is adjusted in a step-wise manner.

18. A controller for a display apparatus, wherein the controller is operable to determine a screen mode of operation for a display apparatus in which at least one among maximum brightness value, color temperature value and contrast ratio value is adjusted in accordance with surface reflectance, color temperature and contrast ratio of a physical paper;

determine gradation ranges for operating the display apparatus in the screen mode, each gradation range having an upper limit gradation value and a lower limit gradation value;

adjust gradation values of an image data associated with each sub-pixel in a frame to generate a first converted image data for the frame, wherein the gradation values of the image data are adjusted to be within a range between the upper limit gradation value and the lower limit gradation value of the corresponding gradation range;

adjust gradation values of the first converted image data associated with each sub-pixel in the frame by a scaling factor;

adjust the brightness of a backlight by an inverse proportion of the scaling factor, and adjust a frame rate of the display apparatus.

19. The controller of claim 18, wherein the first converted image data includes the gradation values associated with a plurality of red sub-pixels, a plurality of green sub-pixels, and a plurality of blue sub-pixels that are adjusted by the following equation, $$R_{output} = R_{min} + \frac{R_{max} - R_{min}}{2^n - 1} \times R_{input} \quad \text{Eqn (1)}$$

-continued $$G_{output} = G_{min} + \frac{G_{max} - G_{min}}{2^n - 1} \times G_{input} \quad \text{Eqn (2)}$$

$$B_{output} = B_{min} + \frac{B_{max} - B_{min}}{2^n - 1} \times B_{input} \quad \text{Eqn (3)}$$

wherein, $R_{input}$, $G_{input}$ and $B_{input}$ denote initial gradation values of the image data associated with one of the red sub-pixel, one of the green sub-pixel and one of the blue sub-pixel; $R_{output}$, $G_{output}$ and $B_{output}$ denote the gradation values in the first converted image data; $R_{max}$, $G_{max}$ and $B_{max}$ denote the upper limits of the respective gradation range; $R_{min}$, $G_{min}$ and $B_{min}$ denote the lower limits of the respective gradation range; and n denotes the number of bits of the image data.

20. The controller of claim 18, wherein the generation of the first converted image data and the calculation of the scaling factor is performed for a plurality of frames.

* * * * *